United States Patent [19]

Change, III

[11] Patent Number: 4,885,195

[45] Date of Patent: Dec. 5, 1989

[54] EXERCISE TOWEL WITH MAGNETIC ANCHORING MEANS

[76] Inventor: Nicholas D. Change, III, 21592 Marilla St., Chatsworth, Calif. 91311

[21] Appl. No.: 222,026

[22] Filed: Jul. 21, 1988

[51] Int. Cl.[4] ..... B32B 3/06

[52] U.S. Cl. ..... 428/36.1; 428/36.2; 428/79; 428/88; 428/99; 428/100; 428/122; 428/124; 428/223; 428/900

[58] Field of Search ..... 428/36.1, 36.2, 88, 428/79, 99, 100, 122, 124, 223, 900; 15/209 R

[56] References Cited

U.S. PATENT DOCUMENTS 3,938,570 2/1976 Stewart ..... 150/52 G 4,195,378 4/1980 Parker ..... 428/99

4,403,366 9/1983 Lucke ..... 15/209 R

*Primary Examiner*—Marion C. McCamish

*Attorney, Agent, or Firm*—Roger A. Marrs

[57] ABSTRACT

An accessory is disclosed herein for use during exercise including a layer of towel material having opposite tufted surfaces. One surface is employed for carrying a pocket having a closable end for insertably receiving personal items such as keys, money, etc. A magnetic anchor is carried on the edge marginal region of the towel midway between its opposite ends for releasably attachment to ferro-magnetic material intended to support the towel, such as an exercise stand, platform support or the like.

1 Claim, 2 Drawing Sheets

EXERCISE TOWEL WITH MAGNETIC ANCHORING MEANS

BACKGROUND OF THE INVENTION

1. Field of the Invention

The present invention relates generally to exercise accessories and, more particularly, to a self-supporting exercise towel which incorporates novel means for releasably securing the exercise towel to ferro-magnetic exercise equipment.

2. Brief Description of the Prior Art

In the past, it has been the conventional practice for a person who exercises at a gym or health club to carry with him an ordinary household towel to absorb perspiration generated through strenuous physical activity. Obviously, it is extremely cumbersome for a person to grasp a towel while using exercise equipment, making it desirable for him to locate a clean resting place for such a towel. To avoid contamination, this procedure necessitates that the exerciser repeatedly search for a clean resting place for his towel as he moves from exercise machine to exercise machine. Prior to this invention, many towels were left to rest directly on the gym floor. Since ordinary towels lack the means for self-support, they are often placed on usable portions of exercise equipment within the user's close proximity whereby frequently interfering with fellow exercisers attempting to use the exercise equipment.

Also, exercise clothing seldom includes pockets, thus allowing the exerciser to maintain a comfortable status during awkward positions achieved while exercising. This places the exerciser in a disadvantageous situation by denying him a sealable pocket on his person to carry essential possessions such as keys and health club membership identification. Towels incorporating pocket means are not new in the art; however, these pockets are large and cover a substantial portion of the towel, thereby limiting the useful absorption area and are generally not practical, further burdening its user to locate a clean, unobstructive resting place.

Therefore, a long standing need has existed to provide a self-supporting exercise towel having magnetic means to uphold itself and facilitate temporary attachment to the ferro-magnetic supporting structural members used in the construction of exercise equipment, affording its user a clean unintrusive resting place on the side and rear portions of this equipment. Also, a need is present to provide a smaller sealable pocket means on an exercise towel to allow the user to carry essential possessions with him. The self-supporting exercise towel herein disclosed, therefore, represents a substantial improvement over currently available exercise towels.

SUMMARY OF THE INVENTION

Accordingly, the above problems and difficulties are obviated by the present invention which provides a novel exercise accessory which includes a sheet or layer of tufted material having top and bottom surfaces, and which further incorporates a pocket means in the corner of one surface adapted to insertably receive personal items of the user. Closure means is included for sealing the pocket after insertion of such personal items and the pocket further includes an area for carrying advertising or display indicia, such as graphic or alpha/-numeric characters. Midway between the opposite ends of the sheet or layer of tufted material, there is provided an anchoring means along a selected edge marginal region thereof incorporating magnetic force in order to support the tufted sheet or layer from ferro-magnetic material, such as an exercising stand, rack or platform.

In one form of the invention, the anchoring means includes a pocket for insertably receiving a magnet which is releasably held within the pocket by a securement means. In another form of the invention, the anchoring means includes a U-shaped magnet which is disposed about the edge marginal region of the sheet or layer midsection in a nonremovable or permanent relationship.

Therefore, it is among the primary objects of the present invention to provide an accessory for a person engaged in an exercising procedure which takes the form of a towel having storage means for holding personal articles and a magnetic anchoring means for supporting the towel from structure, such as an exercising platform or stand.

Another object of the present invention is to provide a novel means for supporting a towel while the user is performing an exercising procedure.

A further object of the present invention is to provide a novel means for supporting a towel while the user is performing an exercising procedure so that the towel is self-supporting on structure near the user.

BRIEF DESCRIPTION OF THE DRAWINGS

The features of the present invention which are believed to be novel are set forth with particularity in the appended claims. The present invention, both as to its organization and manner of operation, together with further objects and advantages thereof, may best be understood with reference to the following description, taken in connection with the accompanying drawings in which:

DESCRIPTION OF THE PREFERRED EMBODIMENT

Figure 1:
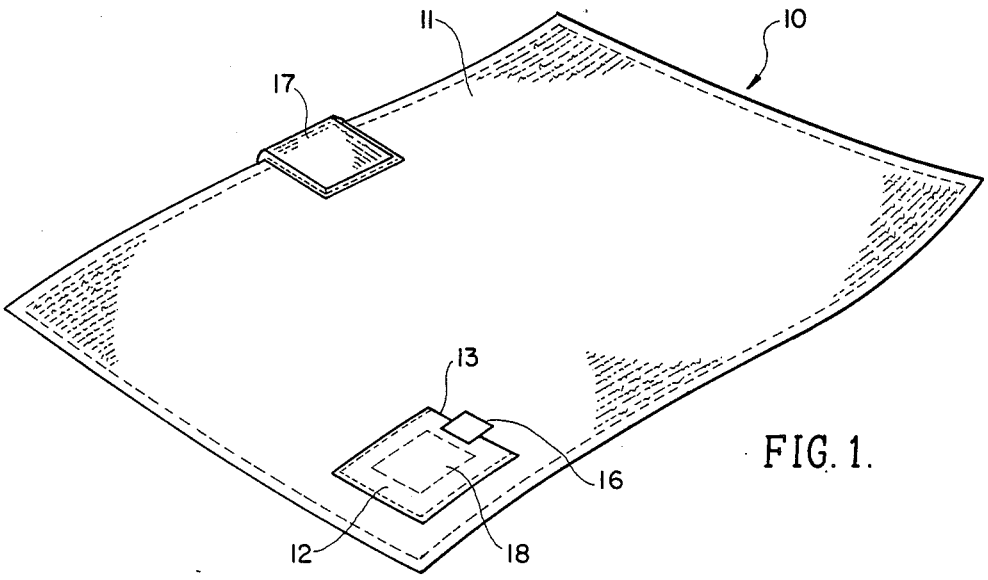
FIG. 1 is a front perspective view showing the novel exercise accessory of the present invention taking the form of a towel.
Figure 3:
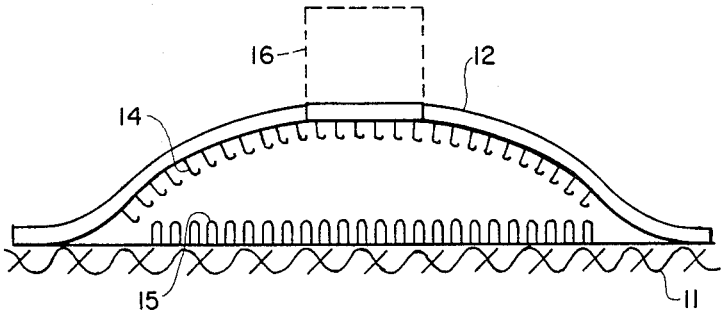
FIG. 3 is a fragmentary cross-sectional view of the pocket carried on one surface of the towel shown in FIG. 2 as, taken in the direction of arrows 3—3 thereof.

Referring to FIG. 1, the novel towel accessory of the present invention is illustrated in the general direction of arrow 10 which includes an elongated tufted towel 11 having opposite surfaces which carry a roughened or toughened surface. A selected corner of the towel on a predetermined surface is provided with a pocket as indicated by numeral 12 which may take the form of material which has been stitched onto the towel leaving one end open so as to insertably receive any one of several personal articles. Keys, money, cards or the like can be inserted through the opening into the interior of the pocket. A closure 13 is provided taking the form of a hook and pile fastener, as shown more clearly in FIG. 3. The hooks of the fastener are indicated by numeral 14, while the pile is indicated by numeral 15. A tab may be used to open the closed end of pocket 12.

FIG. 1 further illustrates a means for anchoring the towel to supporting structure such as a platform, stand or other magnetic material which may be in the close vicinity to the area in which the user is performing an exercising procedure. In one form of the invention, the anchoring means may take the form of a U-shaped magnet 17 covered with fabric so as to be able to be stitched or otherwise fastened to the midsection of the towel 11 midway between its opposite ends along an edge marginal region.

Figure 2:
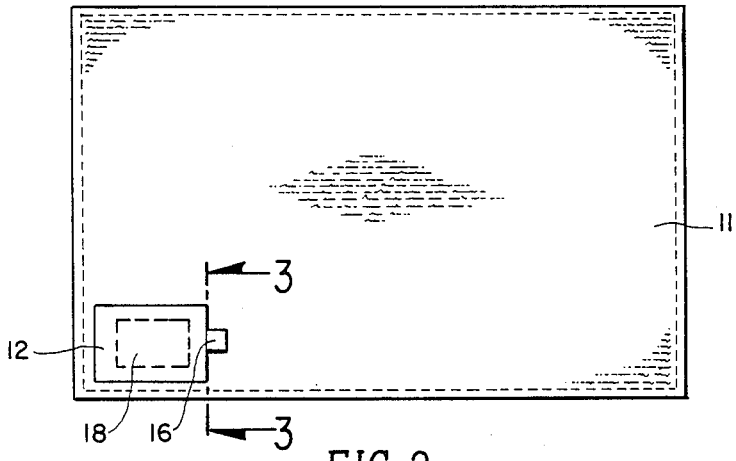
FIG. 2 is a top plan view of the towel accessory shown in FIG. 1.

Referring now in detail to FIGS. 1 and 2, it can be seen that the pocket 12 further includes a central area 18 intended to carry graphic representations, alpha/numeric characters or other indicia for display purposes. Advertising, manufacturing information and other attention indicia may be printed, bonded or otherwise secured to the area for display purposes. It is also to be noted in FIG. 2 that the anchoring means need not be employed in every instance since the towel may be used with the pocket 12 alone.

Figure 4:
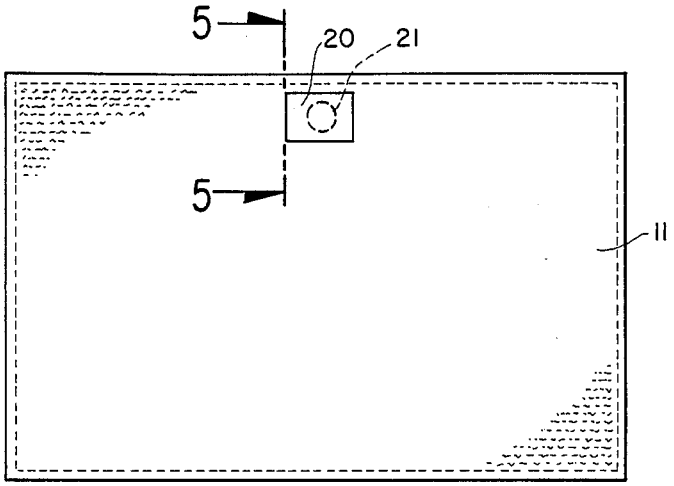
FIG. 4 is a top plan view of another embodiment incorporating the present invention.
Figure 5:
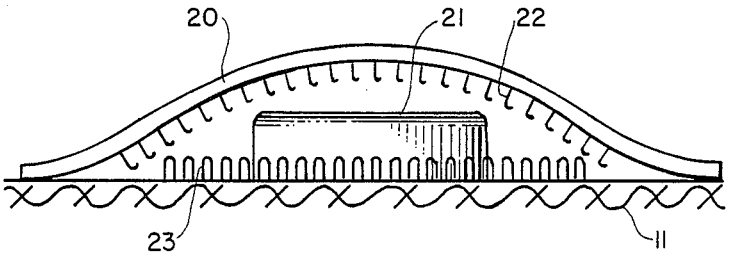
FIG. 5 is an enlarged fragmentary cross-sectional view of a portion of the towel shown in FIG. 4 as taken in the direction of arrows 5—5 thereof.

Referring now in detail to FIGS. 4 and 5, it is readily seen that another anchoring means can be employed wherein a pocket 20 is stitched or otherwise incorporated onto the surface of the towel 11 for receiving a permanent magnet 21 therein. In this instance, the pocket is open-ended so that the magnet 21 may be removed when it is desired to launder the towel. The pocket may be stitched along the edge marginal region of the towel 11 midway between its opposite ends and the magnet may be permanently included within the pocket 20 or the pocket may be fitted with a closable opening to permit selective removal, as previously described. Also, it is to be noted in FIG. 4 that the invention includes the anchoring means without provision for the pocket for holding personal articles.

FIG. 5 is a view of the magnet pocket 20 enclosing the magnet 21 and a hook and pile fastener indicated by numerals 22 and 23 respectively which can be used for selectively closing the opening to the pocket 20.

Figure 6:
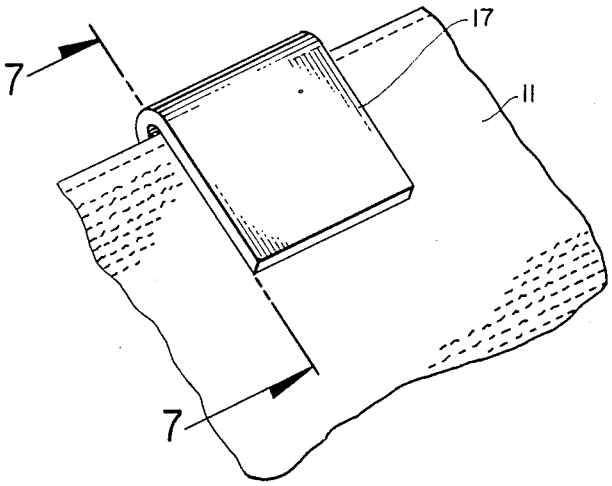
FIG. 6 is an enlarged view of a magnetic anchoring means.
Figure 7:
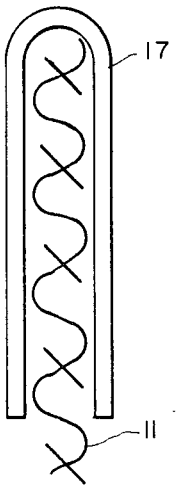
FIG. 7 is a transverse cross-sectional view of the anchoring means shown in FIG. 6 as taken in the direction of arrows 7—7 thereof.

Referring now in detail to FIGS. 6 and 7, the U-shaped magnet 17 may be stitched into the material as shown in FIG. 1 or may be simply a clip-on as shown in FIGS. 6 and 7. The thickness of the towel 11 is placed between the opposing sides of the legs forming the U-shaped magnet 17 and the magnet is retained in position due to frictional engagement therewith. When it is desired to launder the towel 11, the magnet 17 may simply be forcibly withdrawn from its frictional contact with the towel, and after laundering, the magnet can be replaced.

While particular embodiments of the present invention have been shown and described, it will be obvious to those skilled in the art that changes and modifications may be made without departing from this invention in its broader aspects and, therefore, the aim in the appended claims is to cover all such changes and modifications as fall within the true spirit and scope of this invention.

What is claimed is:

1. An accessory for use by a person performing an exercise procedure comprising the combination of:

an elongated length of tufted material having edge marginal regions defining opposite roughened surfaces;

magnetic anchoring means carried on said edge marginal regions for radiating a magnetic force field immediately about said anchoring means;

said anchoring means includes a pocket carried on one surface of said material fully and solely enclosing and holding said magnetic means;

said magnetic anchoring means is a permanent magnetic enclosing and carried in said pocket on said edge marginal region in engagement with said material opposite surfaces;

a hook and pile closure incorporated into said pocket for selectively opening and closing access into said pocket;

said magnetic anchoring means is a circular magnetic insertably received into and carried by said pocket;

a second pocket carried at one end of said material having an open end for insertably receiving personal items;

closure means on said second pocket for releasably closing said pocket open end; and a display area on said second pocket for carrying selective indicia and graphic representations.

* * * * *